US009994291B2

(12) United States Patent
Scott

(10) Patent No.: US 9,994,291 B2
(45) Date of Patent: Jun. 12, 2018

(54) STABILIZING APPARATUS

(71) Applicant: Martin Scott, Kettering (GB)

(72) Inventor: Martin Scott, Kettering (GB)

( * ) Notice: Subject to any disclaimer, the term of this patent is extended or adjusted under 35 U.S.C. 154(b) by 0 days. days.

(21) Appl. No.: 15/089,615

(22) Filed: Apr. 4, 2016

(65) Prior Publication Data

US 2016/0288885 A1 Oct. 6, 2016

(30) Foreign Application Priority Data

Apr. 2, 2015 (GB) ..... 1505799.5

(51) Int. Cl.
*B63B 1/28* (2006.01)
*B63B 39/06* (2006.01)

(52) U.S. Cl.
CPC ..... *B63B 39/061* (2013.01); *B63B 39/06* (2013.01); *B63B 1/286* (2013.01); *B63B 2039/065* (2013.01)

(58) Field of Classification Search
CPC ..... B63B 39/061; B63B 39/062; B63B 2039/065; B63B 2001/281; B63B 1/283; B63B 1/285; B63B 1/286; B63B 25/381; B63H 20/34; B63H 25/381; B63H 25/382
See application file for complete search history.

(56) References Cited

U.S. PATENT DOCUMENTS 6,453,836 B1 * 9/2002 Ditmore ..... B63B 39/06 114/136
7,568,443 B2 * 8/2009 Walker ..... B63B 39/06 114/162
2007/0157864 A1 * 7/2007 Aldin ..... B63B 1/107 114/281

FOREIGN PATENT DOCUMENTS

DE 3713176 A1 * 8/1988 ..... B63B 1/285
WO WO2013/0095097 6/2013

* cited by examiner

*Primary Examiner* — Andrew Polay
(74) *Attorney, Agent, or Firm* — Merek, Blackmon & Voorhees, LLC

(57) ABSTRACT

A stabilizing apparatus for a waterborne vessel is disclosed, the stabilizing apparatus comprising a stabilizer unit, said stabilizer unit comprising: an elongate main body suitable for attachment to said a waterborne vessel; a stabilizing fin member rotatably coupled to said elongate main body about a first axis of rotation; and a drive apparatus attached to said main body and operatively coupled to said stabilizing fin member.

9 Claims, 10 Drawing Sheets

STABILIZING APPARATUS

CROSS REFERENCE TO RELATED APPLICATIONS

This application claims priority from United Kingdom Patent Application No. 15 057 99.5 filed Apr. 2 2015, the whole contents of which are incorporated herein by reference in their entirety.

BACKGROUND OF THE INVENTION

1. Field of the Invention

The present invention relates to the field of stabilising equipment for reducing unwanted motions of waterborne vessels. More particularly but not exclusively, it relates to such stabilising equipment mountable to small waterborne vessels, such as motorboats, cabin cruisers, and the like.

2. Description of the Related Art

Excessive motion of a ship, boat or other vessel in rough seas can lead to a range of problems. Passengers without good "sea-legs" may become sea-sick as a result of either regular or irregular motions of a vessel. More seriously, excessive motion of the vessel, whether pitching, yawing and/or rolling can lead to injury to passengers and crew, damage to cargo and to ship's equipment, and in the extreme case to loss of the vessel, for example by capsizing.

It has been known for some time that stabilisers can be fitted to reduce unwanted motions of ships, particularly of passenger vessels and ferries. Such stabilisers can be fitted during construction or during refit, and conventionally comprise fins or paddles extending outwardly from the ship's hull below the waterline. Such stabilisers are usually controlled to move actively to counteract predictable motions, such as rolling.

Such stabilisers increase the beam and/or draught of the vessel, as they need to project significantly outwardly beyond the hull to have significant effect. It is hence usually necessary for the stabilisers to be foldable against the ship's hull, or to be retractable inboard, particularly when a vessel is in restricted waters or is docking. This all requires complex and bulky operating mechanisms, occupying significant hull volume.

These stabilisers are hence complex and expensive, and do not scale down readily for use on smaller vessels, such as so-called "pleasure craft", including cabin cruisers, motorboats and dinghies.

There is hence a need for a stabilising system that can readily be mounted to a range of small craft, optionally temporarily, without excessive/expensive refitting, which is effective in the water conditions likely to be encountered by such craft, and which does not affect the handiness, ease of docking, versatility and/or shallow draft of such small craft.

BRIEF SUMMARY OF THE INVENTION

According to a first aspect of the present invention, there is provided a stabilising apparatus for a waterborne vessel comprising a stabiliser unit, said stabiliser unit comprising: an elongate main body suitable for attachment to said a waterborne vessel; a stabilising fin member rotatably coupled to said elongate main body about a first axis of rotation; and a drive apparatus attached to said elongate main body and operatively coupled to said stabilising fin member.

Preferably, said drive apparatus is configured to exert a torque on said stabilising fin member to cause said stabilising fin member to rotate about said first axis of rotation.

Preferably, said elongate main body is configured for attachment to said a waterborne vessel adjacent a proximal end of said elongate main body, and in which said stabilising fin member is rotatably coupled to said elongate main body adjacent a distal end of said elongate main body.

Preferably, said drive apparatus is releasably attached to said elongate main body to facilitate separation of said drive apparatus from said elongate main body.

Preferably, said drive apparatus comprises a motor apparatus and a first drive transmission mechanism operatively coupled to an output shaft of said motor apparatus.

Preferably, said motor apparatus comprises an electric motor.

Preferably, said elongate main body comprises a second drive transmission mechanism mechanically coupled to said stabilising fin member.

Preferably, said first drive transmission apparatus of said drive apparatus is configured to releasably engage said second drive transmission apparatus of said elongate main body to mechanically couple said drive apparatus to said stabilising fin member.

Preferably, said stabiliser unit is configured for releasable attachment to said a waterborne vessel.

Preferably, said stabilising fin member is rotatably coupled to said elongate main body about a second axis of rotation.

Preferably, the stabilising apparatus further comprises a mounting apparatus suitable for mounting of said stabiliser unit to said a waterborne vessel.

Preferably, said stabilising fin member is rotatable relative to said mounting apparatus about a third axis of rotation.

Preferably, said elongate main body is rotatable relative to said mounting apparatus about said third axis of rotation.

Preferably, said stabilising apparatus further comprises a control system configured to control the operation of said drive apparatus.

Preferably, said control system comprises a proportional-integral-derivative (PID) controller.

BRIEF DESCRIPTION OF THE DRAWINGS

The invention will now be described by way of example only with reference to the accompanying drawings, which are purely schematic and not to scale, of which.

DETAILED DESCRIPTION OF EXAMPLE EMBODIMENTS

FIG. 1

Figure 1:
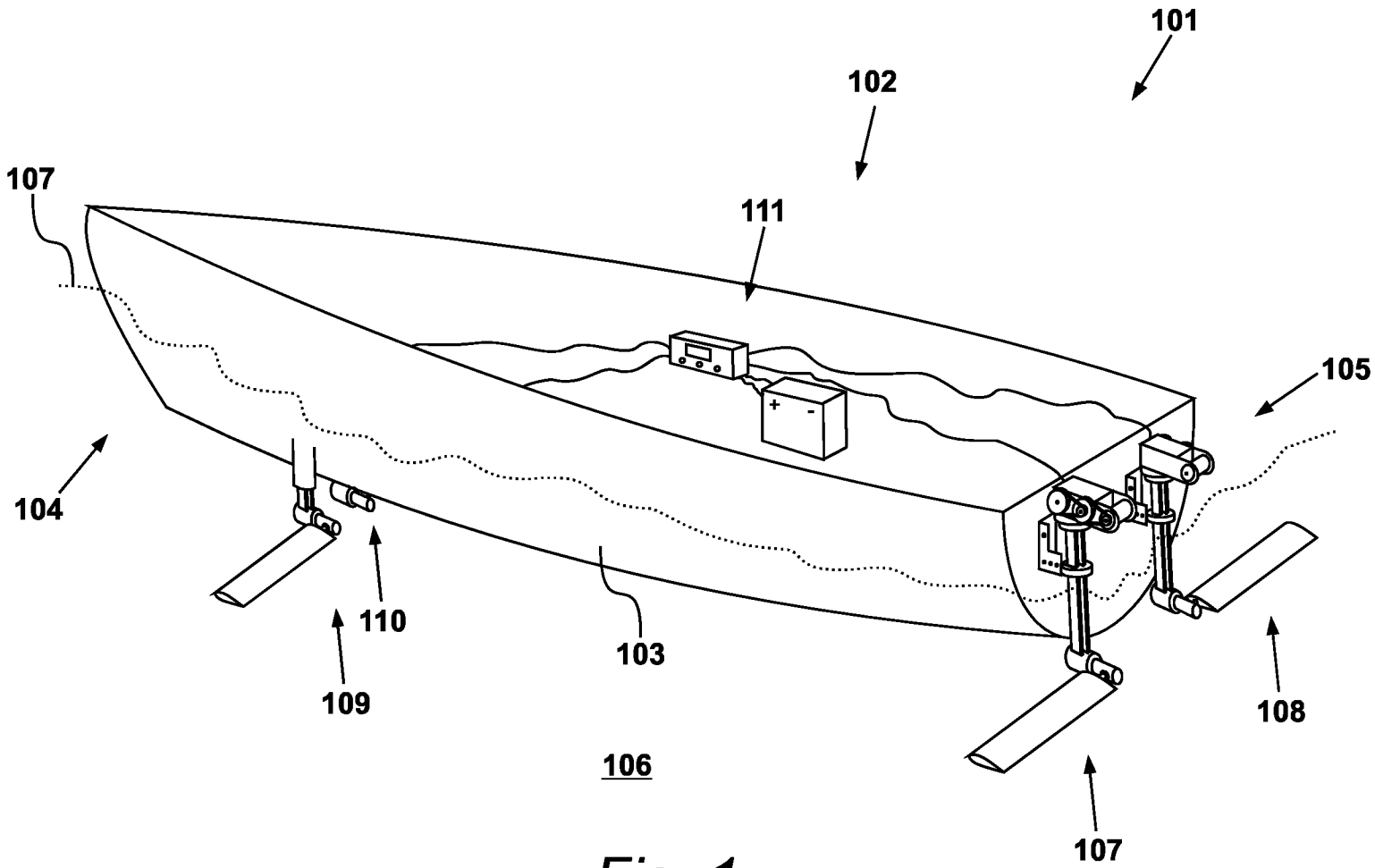
FIG. 1 is an illustration of an exemplary environment in which the present invention can be used.

An example of an environment in which the present invention can be used is illustrated in FIG. 1. A waterborne vessel 101 is equipped with a stabilising apparatus, indicated generally by 102, according to a specific embodiment of the present invention.

In the example, waterborne vessel 101 is a boat of substantially conventional form, having a hull 103, extending from its bow 104 to its stern or transom 105. In the specific embodiment, waterborne vessel 101 is a relatively small size pleasure craft, such as may be used for recreational purposes by a small number of passengers, for example, for use in sporting activities such as fishing. It will of course be appreciated however that although the specific embodiment of the invention described herein has particular utility in relation to small boats used for recreational purposes, or even model boats, alternative embodiments of the invention may be used in conjunction with larger vessels, for example, commercial cargo shipping vessels or passenger ferries.

The means of propulsion of the boat 101 are omitted from the Figures in order to avoid un-necessarily obscuring components of the stabilising apparatus 102. In this respect, the skilled person will be entirely familiar with the various conventional means of propulsion of boat 101. For example, a dinghy or yacht will have a mast and sailing rig extending upwardly from the hull, whilst a motor boat will generally have an outboard motor fitted to the transom 105, along the centreline of the hull 103. A larger motorised boat, for example, the aforementioned commercial cargo vessel, may be equipped with an engine within the hull 103 driving a propeller mounted adjacent a lowest point of the transom 105, again, aligned with the centreline of the hull. A rudder used for steering of the boat would typically be mounted to the transom 105 on the centreline, but is similarly omitted from view to improve clarity.

Boat 101 is immersed in a body of water 106, for example, the sea, up to the waterline 107, the height of the waterline 107 up the hull 103 being dictated by the geometry of the hull 103, overall mass of boat 101, and the density of the water 106 in which the boat is immersed.

In the example, stabilising apparatus 102 comprises a plurality of like stabiliser units, indicated generally at 107 to 110. In the embodiment, the primary function of stabilising apparatus 102 is to stabilise the motion of the boat 101, so as to prevent excessive rolling and pitching of the boat 101, as may be experienced, for example, if the boat 101 is used in rough waters. In the specific embodiment described herein however the stabilising apparatus 102 performs the secondary function of operating to vary the height of boat 101 in the water, so as to have the effect of altering the height of waterline 103, as will be described further with reference to FIG. 4*a*.

In the specific embodiment illustrated, stabilising apparatus 102 comprises matching port and starboard stern stabiliser units 107, 108, which in the embodiment, as will be described, are substantially identical in construction. Each stabiliser unit 107, 108 is mounted to the transom 105, to port or starboard respectively of the centreline of the hull. In the specific embodiment, the stabiliser units 107, 108 are releasably attached to the transom 105, so that they may be readily detached between periods of use. Depending on the exact embodiment, the stabiliser units 107, 108, may be permanently mounted to the boat 101 or may be on detachable mountings, which may also be pivotable. Whilst mountings conventionally used for outboard motors may be suitable, a preferred mounting according to a specific embodiment of the present invention will be described in further detail with reference to later Figures.

As shown in the Figure, in the embodiment, stabilising apparatus 102 further comprises matching bow stabiliser units 109, 110 (bow stabiliser unit 110 largely obscured from view in FIG. 1 and more clearly visible in FIGS. 4*b* and 4*c*), which bow stabiliser units 109, 110 are each substantially identical in construction to transom stabiliser units 107, 108. Each stabiliser unit 109, 110 is mounted directly to the hull of the boat, to port or starboard of the centreline of the hull, and are releasably attached to the hull 103 so that they may be readily detached between periods of use.

As illustrated, in the embodiment, stabilising apparatus 102 further comprises a control system, indicated generally at 111 configured to control the operation of said stabiliser units 107 to 110.

The configuration of stabiliser units 107 to 110 will be described further with reference to FIGS. 2 to 6, whilst the configuration and operation of control system 111 will be described further with particular reference to FIG. 7.

Figure 2A:
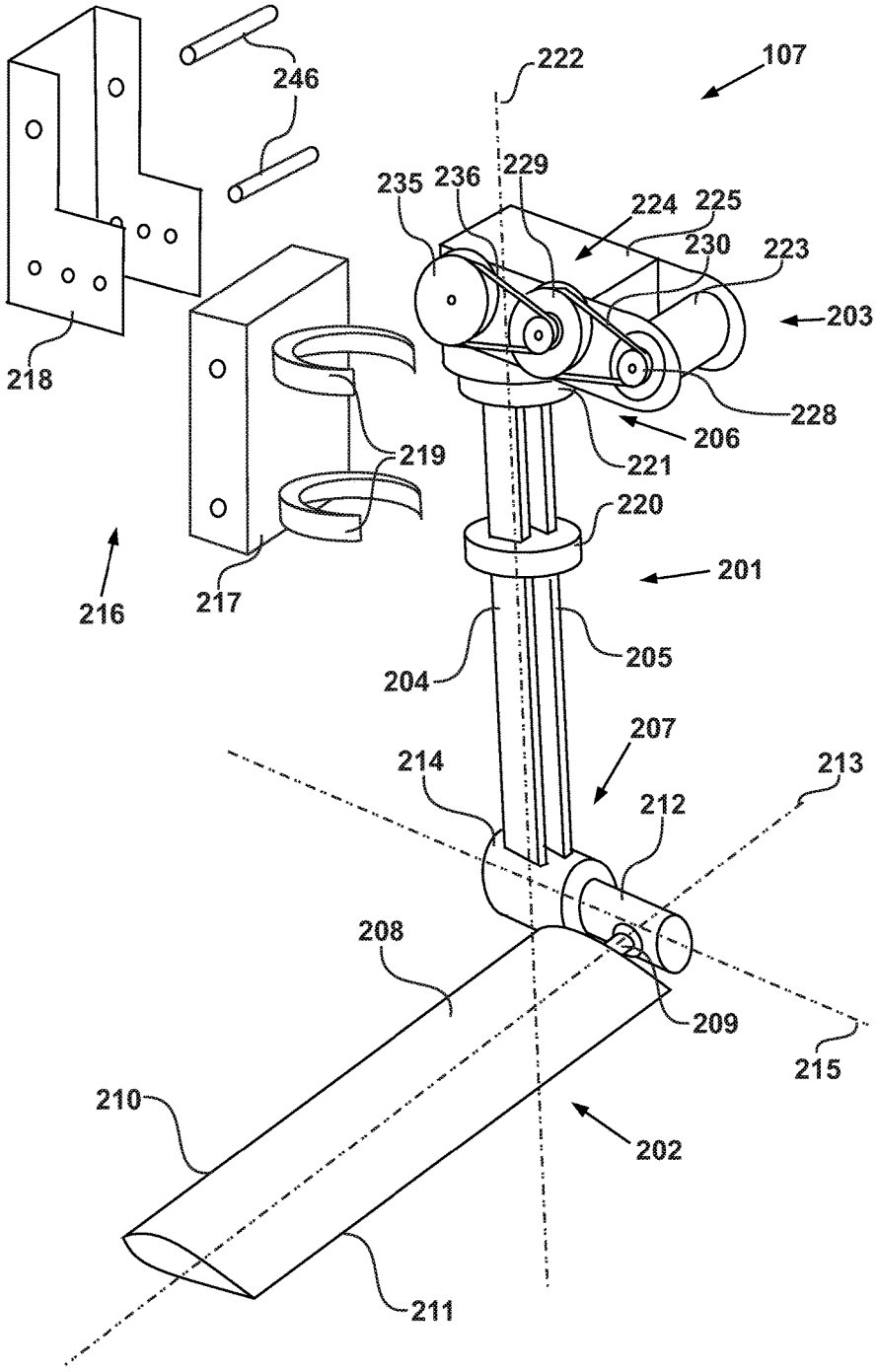
FIG. 2*a* shows the stabiliser unit 107 previously identified in FIG. 1 in isolation in a perspective view.
Figure 2C:
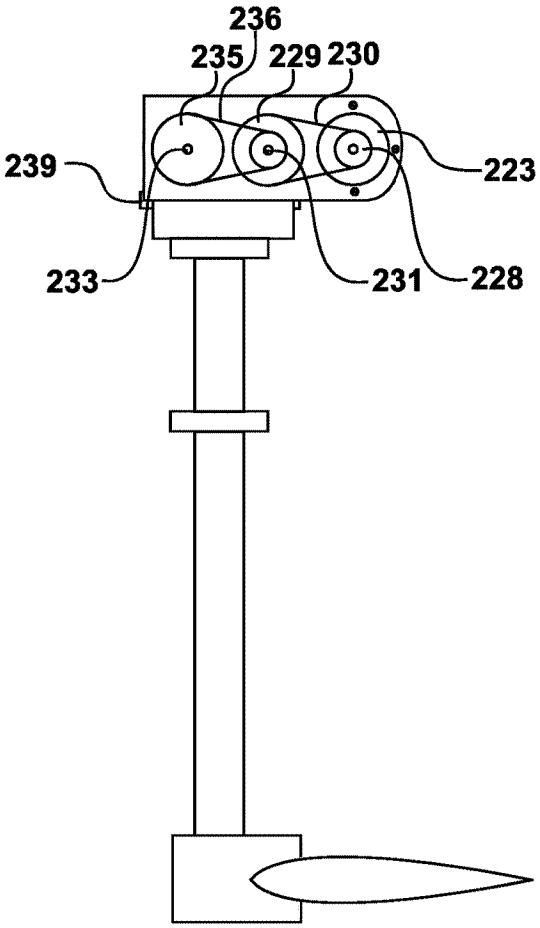
FIG. 2*c* shows the stabiliser unit 107 in an end elevation view.
Figure 2B:
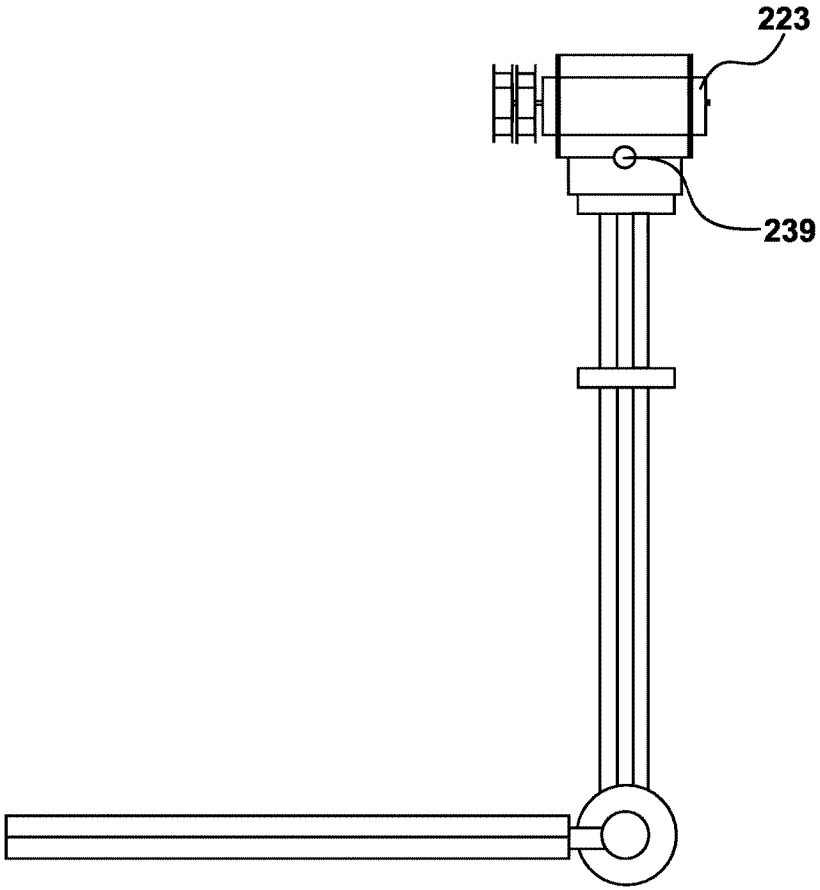
FIG. 2*b* shows the stabiliser unit 107 in a side elevation view.

FIGS. 2*a*, 2*b* & 2*c*

Figure 2E:
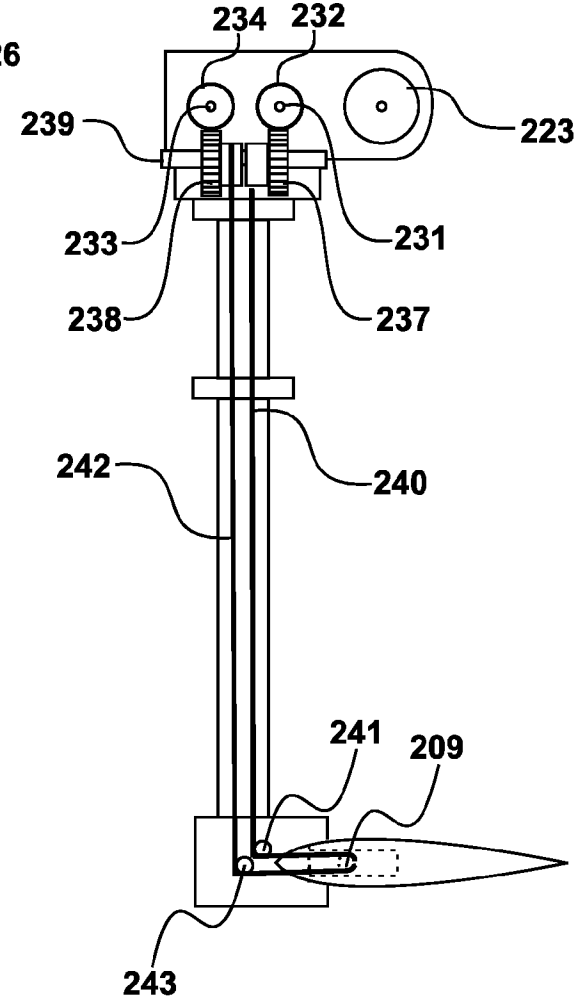
FIG. 2*e* shows the stabiliser unit 107 in an end cross sectional view.
Figure 2D:
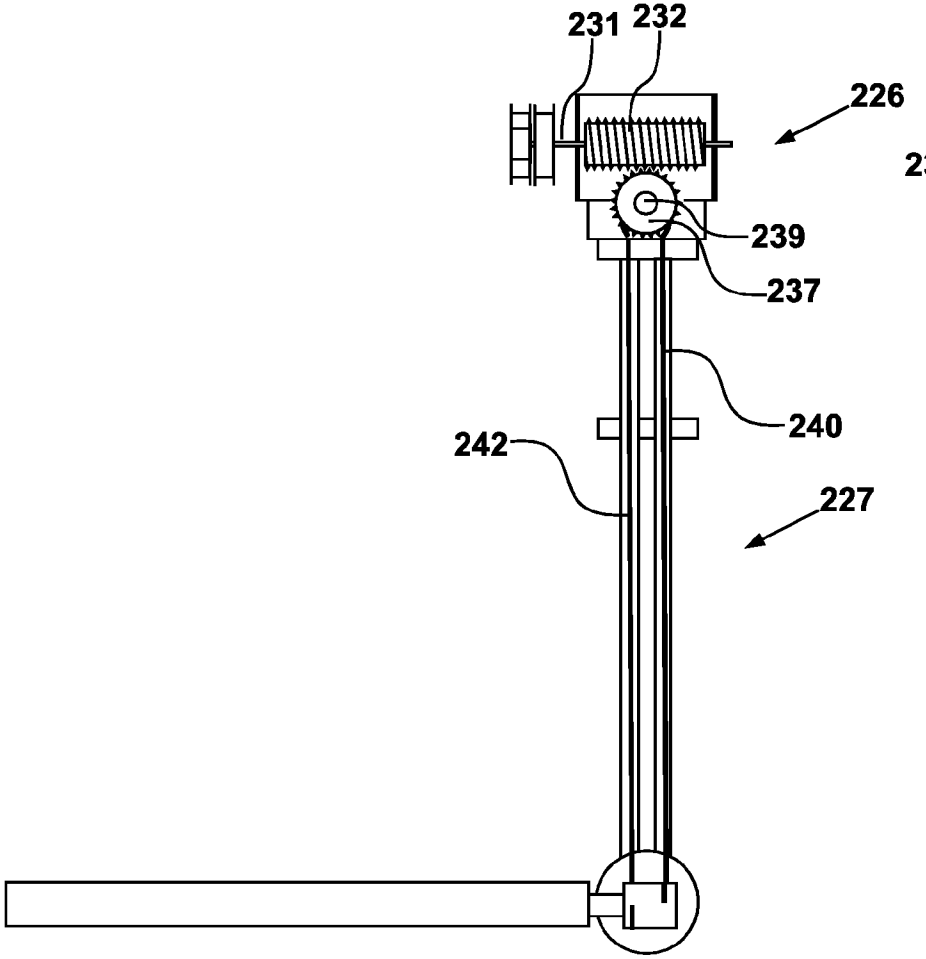
FIG. 2*d* shows the stabiliser unit 107 in a side cross-sectional view.

Stabiliser unit 107 of stabilising apparatus 102 previously identified in FIG. 1 is shown in a perspective view in FIG. 2*a*, in side elevation and end elevation views in FIGS. 2*b* and 2*c*, and in side cross-sectional and end cross-sectional views in FIGS. 2*d* and 2*e*. As previously described, stabiliser units 107 to 110 are substantially identical in construction, save as will be later described.

Referring to the Figures, stabiliser unit 107 comprises generally of an elongate main body 201, a stabilising fin member 202, and a drive apparatus 203. In the specific embodiment illustrated, said elongate main body 201 comprises of an elongate construction formed of two discrete strut sections 204, 205, and extends between proximal and distal ends 206, 207 respectively. A benefit of this construction of elongate main body 201 is that the use of two relatively thinner struts, as opposed to a single relatively thicker strut, results in a more streamlined form and reduces the resistance encountered when the stabiliser unit moves through the water.

In the embodiment, said stabilising fin member 202 comprises of a generally airfoil shaped blade 208 having a leading edge 210 and a trailing edge 211, and a pivot axle 209. Said stabilising fin member 202 is rotatably coupled to said elongate main body 201 adjacent said distal end 207. Pivot axle 209 is rigidly fixed to said blade 208 preventing relative rotation therebetween. It will be appreciated that the dimension of construction of blade 208 will vary according to the intended application. In the specific embodiment illustrated, in which the stabiliser unit is configured for attachment to a small pleasure craft type boat, the blade 208 is relatively short in length, preferably less than one meter, and is formed of a lightweight thermoplastics material. In alternative embodiments of the invention however, the blade 208 may be substantially greater or shorter in length than one meter, and in the case of a stabiliser unit fitted to a larger commercial vessel, may be formed of a high strength steel material.

In the specific embodiment, said fin member 202 is coupled to said distal end 207 of said elongate main body 201 by way of pivot hub 212. Thus, said fin member 202 is rotatable coupled to said pivot hub 212, by partial insertion of said pivot axle 209 into said pivot hub. In the specific embodiment, said pivot hub 212 comprises a bearing element which receives said pivot axle facilitating free rotation therebetween about a first axis of rotation 213 of said fin member 202. Said pivot hub 212 is itself rotatably coupled to said elongate main body 201 adjacent said distal end 207, by partial insertion of said pivot hub 212 into angle connector 214 of elongate main body 201. Similarly, in the embodiment, said angle connector 214 is provided with a bearing element which receives an end of said pivot hub 212, facilitating rotation of said pivot hub 212 relative to said angle connector 214 of said elongate main body 201 about a second axis of rotation 215 of said fin member 202.

In the example said elongate main body 201 is suitable for attachment to a vessel such as boat, and more preferably is configured to be releasably attachable to boat 101 so as to allow stabiliser unit 107 to be readily detached from boat 101 by an operative. In the specific embodiment, stabiliser unit 107 is configured for attachment to the upright transom section 105 of boat 101, and is provided with a mounting apparatus, indicated generally at 216, to allow said stabiliser unit to be releasably mounted to said transom section.

In the embodiment, said mounting apparatus 216 comprises first and second hingedly connected connector portions 217, 218. In the embodiment, said first connector portion 217 is configured to be permanently fixed to said elongate main body 201 adjacent said proximal end 208, and said second connector portion 218 is configured to be permanently fixed to a position on the transom 105 of boat 101 above waterline 107.

As illustrated in the Figure, said first connector portion takes the form generally of a bracket, which includes a pair of annular ring portions 219. Elongate main body 201 is, in this embodiment, provided with circular collars 220, 221 fixedly connected to said struts 204, 205, and said annular ring portions 219 are arranged to surround said circular collars 220, 221 of said elongate main body. The inner diameter of the ring portions 219 is closely matched to the outer diameter of said collars 220, 221 so as to retain the collars 220, 221 securely therein, but also allow rotation of the collars 220, 221, within the ring portions 219. In this way, the elongate main body 201 is rotatable relative to the mounting apparatus 216 defining a third axis of rotation 222 of the fin member 202.

In the specific embodiment, said first and second connector portions are releasably and hingedly connected by hinge pins 246. In this way, the orientation of said first connector portion 217, and thus said elongate main body 201, may be varied relative to the orientation of said second connector portion 218, and thus said transom section 105. This arrangement allows for the stabiliser unit to be fitted to boats having transom sections extending at varying angles relative to the water in which it is immersed, by allowing the orientation of the stabiliser unit 107 relative to the plane of the transom section 105 to be adjusted. Moreover, said hinge pin 246 is configured to be readily removable, to allow separation of said first connector portion 217 from said second connector portion 218, and thereby allow easy detachment of the stabiliser unit 107 from the boat 101.

As previously described, said stabiliser unit is further provided with a drive apparatus indicated generally at 203. Drive apparatus is configured to generate a torque to exert on said stabilising fin member 202, to cause said fin member 202 to rotate about at least one of its three axis of rotation. In the specific embodiment, and as will be described further, drive apparatus 203 is configured to drive said fin member 202 to rotate about only its first axis of rotation 213. In other embodiments however, the drive apparatus may be configured to drive said fin member to rotate about more than one of its axis axis, and indeed, in a particular alternative embodiment, the drive apparatus is configured to drive the fin member to rotate about each of its three axis independently. In the embodiment, said drive apparatus comprises a motor apparatus 223, which in the example is an electric motor, a first drive transmission apparatus 224 operatively coupled to an output shaft of said motor 223, and a housing 225.

Referring to the Figures, as previously described, elongate main body 201 is generally elongate in form, extending from a proximal end configured for connection to a boat above its respective waterline, and a distal end, adjacent which distal end said stabilising fin extends. Elongate main body 201 is thus configured to support said fin member 202 below the waterline of a boat to which it is attached, so as to at least partially immerse the stabilising fin in the body of water. In the embodiment, said drive apparatus 203 is attached to said elongate main body 201 adjacent said proximal end 206, such that said drive apparatus is removed from the water 106 in use.

Referring now particularly to FIGS. 2*d* and 2*e*, said stabiliser unit 107 is provided with a drive transmission mechanism, for transmitting a torque generated by said electric motor to said stabilising fin 202, so as to cause said stabilising fin 202 to rotate about at least one if its axis of rotation. In the example embodiment, stabiliser unit 107 is provided only with a drive apparatus and drive transmission means to allow the fin member 202 to be rotated about it first axis of rotation 213, although in alternative embodiments a similar mechanism(s) may be used to drive the fin member 202 to rotate about its second and third axis of rotation 215, 222.

In the embodiment, said drive transmission mechanism is comprised of two portions, a first drive transmission mechanism 226 forming a part of said drive apparatus 203, and a second drive transmission mechanism 227, forming a part of said elongate main body 201. As will be described further with reference to FIG. 4, the first and second drive transmission mechanisms 226, 227 are releasably engageable, so as to allow removal of said drive apparatus 203 from said elongate main body 201 by disengaging said first drive transmission from said second drive transmission.

Referring to the Figures, said drive apparatus 203 comprises an electric motor 223 operatively coupled to said first drive transmission mechanism 226. In the specific embodiment, said first drive transmission mechanism comprises a first pulley 228 operatively coupled to the output shaft of said electric motor 223 such that pulley 228 is rotationally locked to the motor output shaft. Said first pulley 228 is coupled to a second pulley 229 by way of a toothed drive belt 230. Said second pulley 229 is coupled to an end of rotatable shaft 231 which extends through the housing 225. In the embodiment, shaft 231 defines externally a helical thread 232 extending along the portion of the shaft within housing 225, thereby forming generally a first worm screw.

Said first drive transmission 226 further comprises second shaft 233, which again extends through the housing 225 and has a helical thread 234 extending along a portion of the shaft, thereby forming a second worm screw substantially identical to said first worm screw. Said second shaft 233 comprises a third pulley 235 which is coupled to said second pulley 229 by way of a second ribbed drive belt 236. The pulleys 228, 229, 235 are sized such that the gearing ratio between said first and second shafts 231, 233 is one-one, i.e. the shafts are rotationally locked and rotate at the same speed.

Stabiliser unit 107 is further provided with a second drive transmission mechanism indicated generally at 227, configured to transmit drive from said drive apparatus to said stabilising fin member. In the embodiment, said second drive transmission apparatus comprises first and second worm gears 237, 238. Said first and second worm gears 237, 238, are carried on shaft 239, which shaft 239 extends through housing 225, secured at its ends to housing, and about which said first and second worm gears may freely rotate. Said first worm gear 237 is aligned to mesh with said first worm screw 231. In this way, rotation of said first worm screw 231 causes said first worm gear 237 to rotate about shaft 239. Similarly, said second worm gear 238 is aligned to mesh with said second worm screw 233, such that rotation of said second worm screw causes said second worm gear to rotate about shaft 239.

Said first worm gear 237 is coupled to a first end of a first control cable 240. In the embodiment, said control cable 240 comprises a length of substantially inextensible braided steel cable. The length of said control cable 240 is configured to be marginally greater in length than the distance between the worm gear 237 and the pivot axle 209 to allow the cable to be turned clockwise a half turn about the hub of said first worm gear 237, and turned a half clockwise about the pivot axle 209. Control cable 240 extends downwardly through the hollow strut 204 of elongate main body 201, about idle roller 241, and is coupled at a second end to said pivot axle 209. Similarly, said second worm gear 238 is coupled to a first end of a second control cable 242, which cable 242 is substantially similar in construction and length to cable 240. Control cable 242 extends through said strut 205 of said elongate main body 201, about idle roller 243, and is coupled to said pivot axle 209, being turned anti-clockwise a half turn about said pivot axle.

In this way, rotation of motor 223 in a first direction, for example such that the output shaft rotates clockwise when viewed end-on, causes said first and second worm screws 231, 233 to be similarly rotated, thus driving the worm gears 237, 238, which cause control cables 240, 242, to be either pulled or relaxed, thus causing said pivot axle 209 to be rotated about said first axis of rotation 213, causing said fin blade 208 to rotate.

In the embodiment illustrated, only a single motor 223 and associated drive mechanism is provided, such that fin member 202 may only be rotatedly driven about said first axis of rotation 213. In an alternative embodiment however, a second like motor and like drive transmission mechanism is provided to allow said fin member 202 to be driven to rotate about said second axis of rotation 215. Moreover, further like drive means may be provided to allow said fin member 202 to be driven to rotate about said third axis of rotation 222.

Figure 3B:
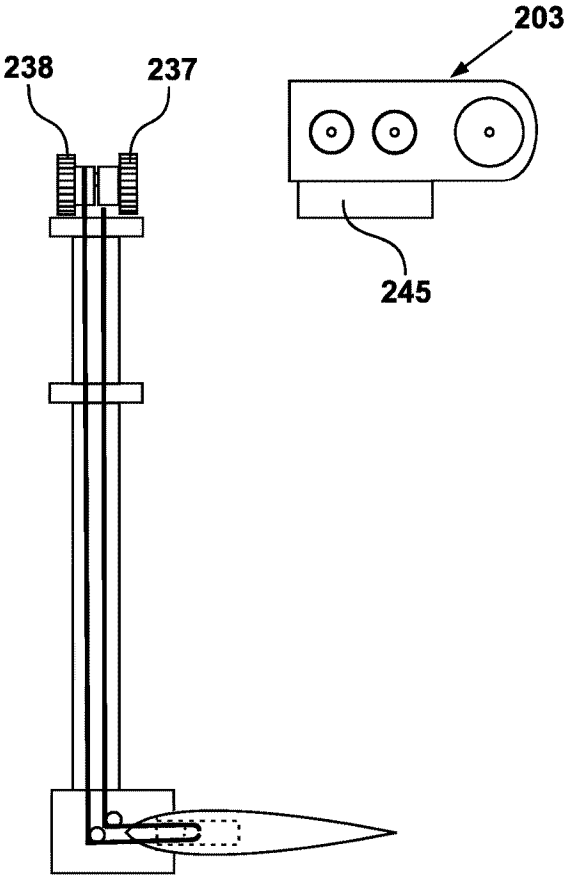
FIG. 3*b* shows the stabiliser unit 107 in an end cross sectional view with the drive apparatus 203 detached.
Figure 3A:
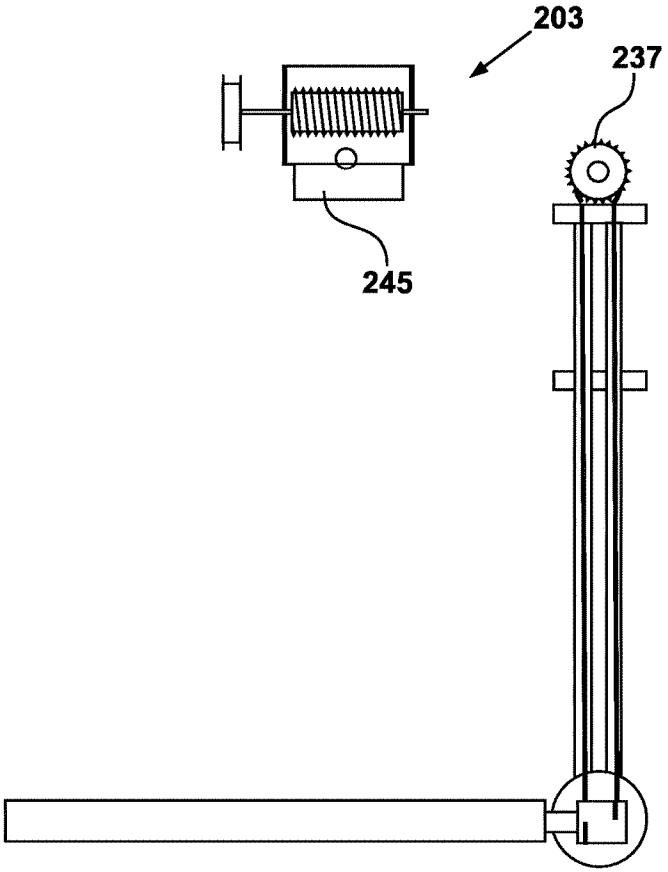
FIG. 3*a* shows the stabiliser unit 107 in a side cross-sectional view with the drive apparatus 203 detached.

FIGS. 3*a* & 3*b*

Stabiliser unit 107 is shown in FIGS. 3*a* and 3*b* with the drive apparatus 203 separated from the elongate main body 201.

As described previously with reference to FIG. 2, in the embodiment, stabiliser unit 107 is configured such that said drive apparatus 203 may be readily detached from said elongate main body when not in use. A particular advantage of this configuration is described later with reference to FIG. 5.

Referring to the Figure, drive apparatus 203 is mechanically coupled to said elongate main body 201 adjacent said proximal end 206 by way of a turn collar 245. Said turn collar 235 is retained by said housing 225 of said drive apparatus, and defines internally a helical thread configured to engage with a corresponding helical thread defined externally adjacent the proximal end 206 of said elongate main body 201. Unscrewing of said collar 235 from said elongate main body 202 mechanically detaches said housing 225 from said elongate main body 201. To facilitate complete removal of said drive apparatus 203 from said elongate main body 201, in the embodiment, said shaft 239 is readily removable from the housing, to thereby disengage said first and second drive transmission mechanisms 226, 227, and allow said elongate main body 201 to be separated from said drive apparatus 203 with minimal disruption to the drive transmission mechanism.

Figure 4A:
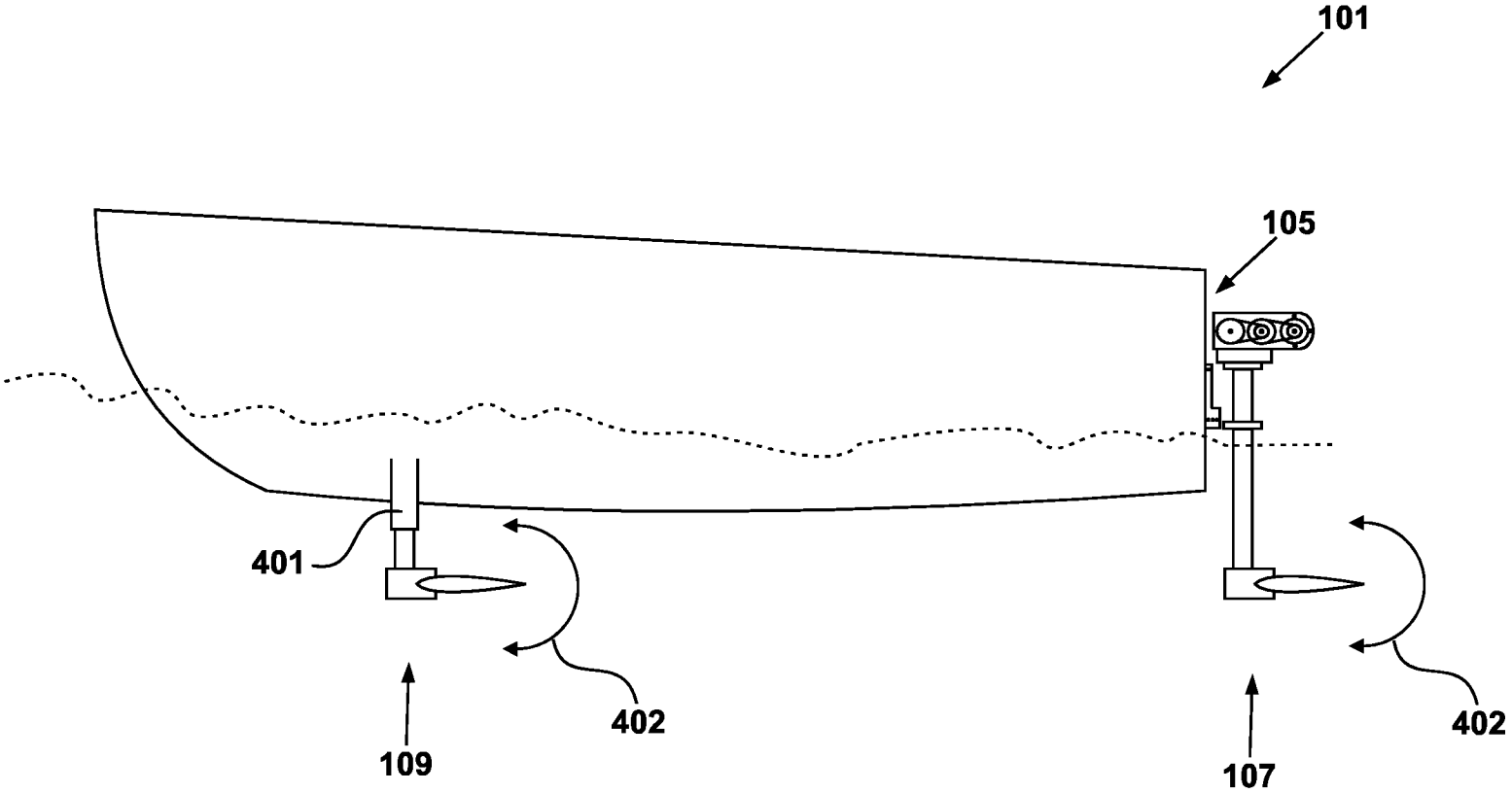
FIGS. 4*a*, 4*b* and 4*c* show boat 101 previously identified in FIG. 1 in schematic side (port), stern elevation, and plan from below the boat views.
Figure 4B:
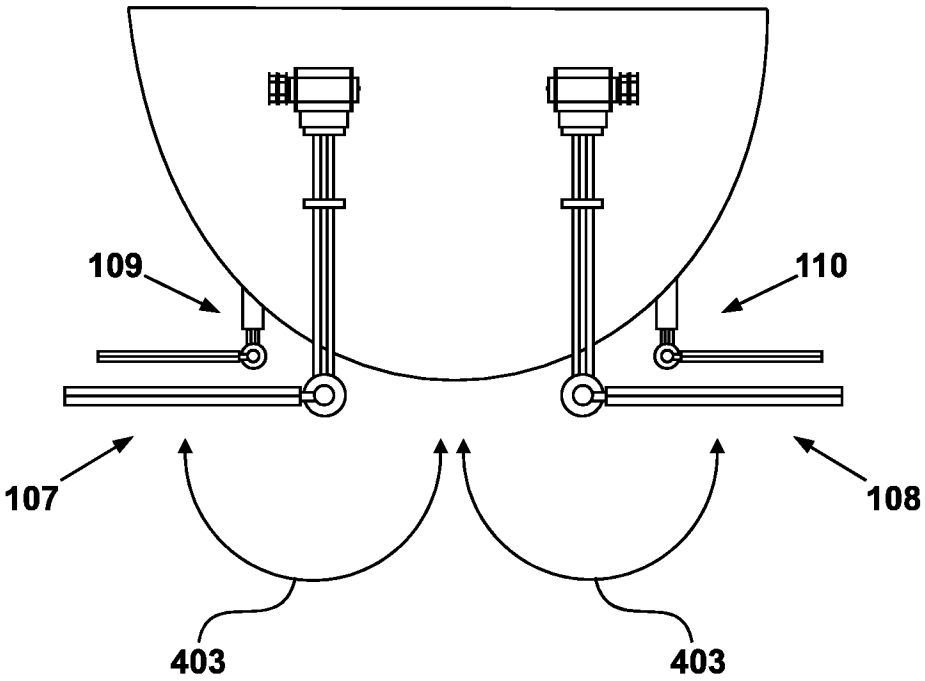
Figure 4C:
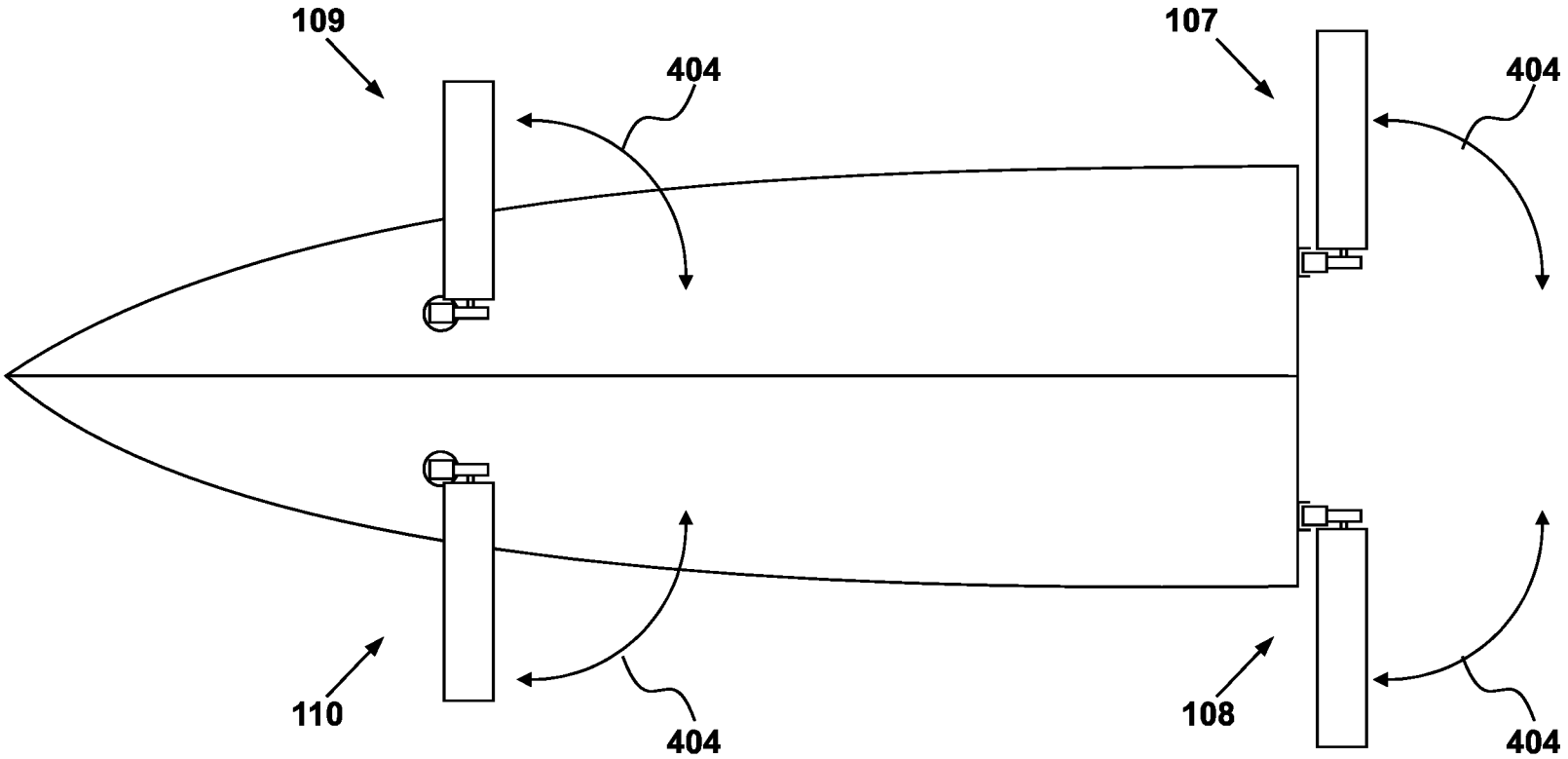
Figure 5:
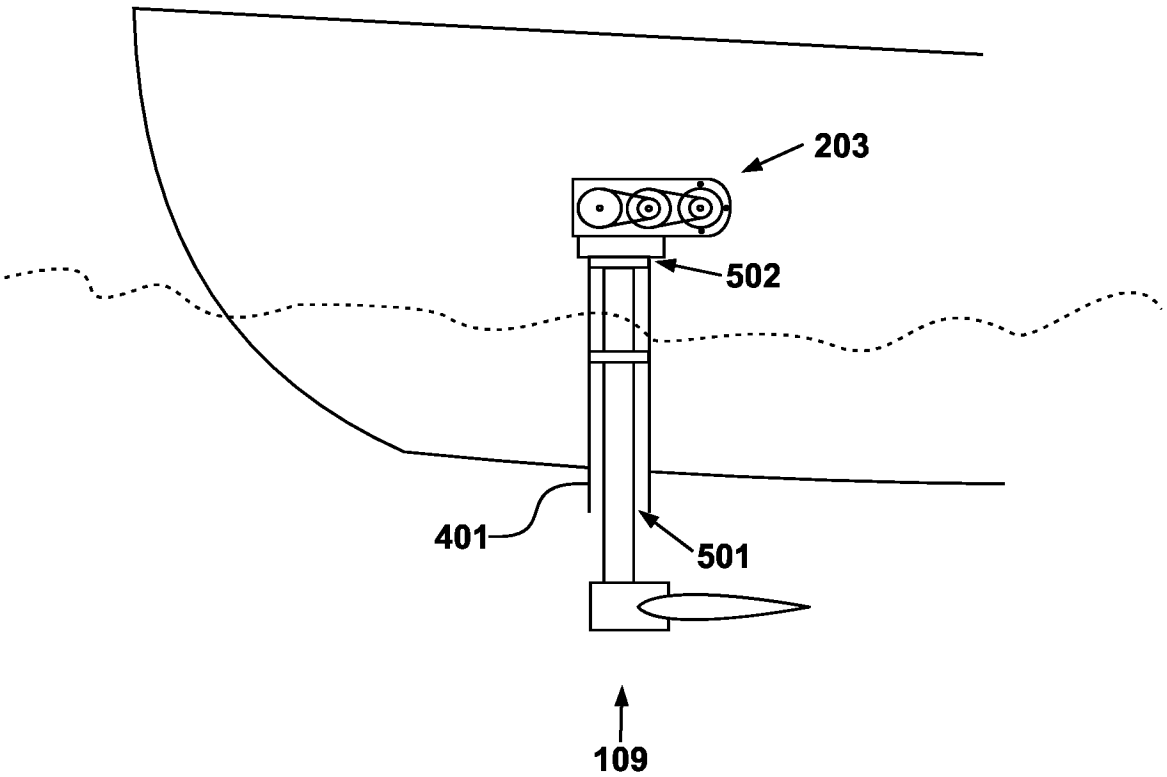
FIG. 5 shows a close up cross-sectional view through the hull 103 of boat 101 showing the attachment of said stabiliser unit 109.

FIGS. 4*a*, 4*b* & 4*c*

Boat 101 previously identified in FIG. 1 is shown in a schematic side (port) view in FIG. 4*a*, a schematic stern elevation view in FIG. 4*b*, and a schematic plan view from below the boat in FIG. 4*c*.

As previously described, in the embodiment, boat 101 is equipped with a stabilising apparatus 102 comprising four like stabiliser units 107 to 110, arranged as a pair of transom stabiliser units 107, 108 and a pair of bow stabiliser units 109, 110.

FIG. 4*a* shows a view of the port-side of the boat 101, in which said port bow stabiliser unit 109 and said port transom stabiliser unit 107 are visible. In the embodiment however the configuration of the stabiliser units is substantially symmetrical about the centreline of the hull.

Turning to the stern of the boat, the stabiliser units 107, 108 are each releasably attached to the transom 105 of the boat 101, to port and starboard of a centreline of the hull 103. In the embodiment, the stabiliser units are attached to the transom 105 by way of mounting apparatus 216, which in the embodiment, as described, takes the form of a two piece bracket configured to allow the stabiliser units 107, 108 to be readily removed from the transom 105 by an operative.

Turning to the bow of the boat, the stabiliser units 109, 110 are each releasably attached to the hull of the boat, to port and starboard of a centreline of the hull. As will be described further with reference to FIG. 5, in the embodiment the hull 103 of boat 101 is provided with open tube housings 401 which extend upwardly from the hull, from a first end which may be formed integrally with the hull and defines an aperture through the hull which extends along each said tube housing towards a second open end inward of the hull, which is arranged to lie above the waterline of the vessel. Thus, said bow stabiliser units 109, 110 are received in said tube housings 401

As described, the stabilising fin member 202 of each of said stabiliser units 107 to 110 is configured for rotation about a first axis of rotation 213, so as to generally cause the fin member to rotate about the pivot axle 209 through the arc 402 identified in FIG. 4*a*. Rotation of said fin member 202 about said first axis of rotation 213 may be used to alter the pitch of the boat 101, and thereby correct for a pitching motion induced on the boat by rough waters.

Furthermore, rotation of the fin members 202 about the first axis 213 may be used to generate a lifting force on the boat, so as to cause the hull 103 of the boat to be partially lifted out of the water by the force of water moving across the fins 202. In this way, resistance to the movement of the hull 103 through water at speed may be reduced.

The stabilising fin member 202 is also rotatable about a second axis of rotation 215, extending generally orthogonally relative to said first axis of rotation 213. The fin member 202 may thus be rotate to extend above or below the horizontal, and also be rotated through roughly a half-circle to extend inboard from the pivot hub 212, e.g. for storage, in calm waters or close to other vessels or structures. Arcs of stabilising fin member 202 about the second axis of rotation 215 are shown in FIG. 4*b*. Rotation of said fin members 202 about said second axis of rotation 215 may be used to correct for roll of the boat 101, and in particular, may be used to 'flap' so as to exert a torque on the boat to stabilise roll of the boat when stationary.

Additionally, the stabilising fin member 202, elongate main body 201, and drive apparatus 203, are in this embodiment rotatable as a unit about a third axis of rotation 222, defined by the rotation of the elongate main body of the stabiliser unit 201 relative to the first connector portion 217 of the mounting apparatus 216. This third axis of rotation allows for the stabilising fin member 202 and associated components of the stabiliser units 107 to 110 to swing back safely if the fin member 202 contacts an obstacle, or floating or submerged debris. The arcs 404 in FIG. 4*c* show how this movement about the third axis of rotation can deflect the blade from an orientation in which it extends outwards of the hull 103, to an orientation in which it extends generally astern.

In some embodiments, the third axis of rotation is spring-loaded, to cause the stabiliser unit to be biased towards the orientation in which the stabilising fin member extends outboard of the hull 103, for example, with coil springs, extension or compression springs, compressed or extended elastomer bodies, hydraulic or compressed-air cylinders, or the like. Alternatively, contact by the fin member 202 with an obstacle, etc, may be senses and the stabiliser unit controllably driven to rotate the fin member 202 about the third axis of rotation to its astern orientation. From here, it may be returned to the original outboard orientation by driving it controllably, or by similar biasing means, once it is no longer driven to swing back. Optionally, the rotation of the fin member 202 about the third axis of rotation may be held or latched, once the fin member 202, etc, has been deflected or driven back to its astern alignment, requiring a specific human or computer controlled release instruction before it returns to its original outboard orientation. The orientation of the fin member 202 may thus form a bi-stable system.

FIG. 5

Figure 6:
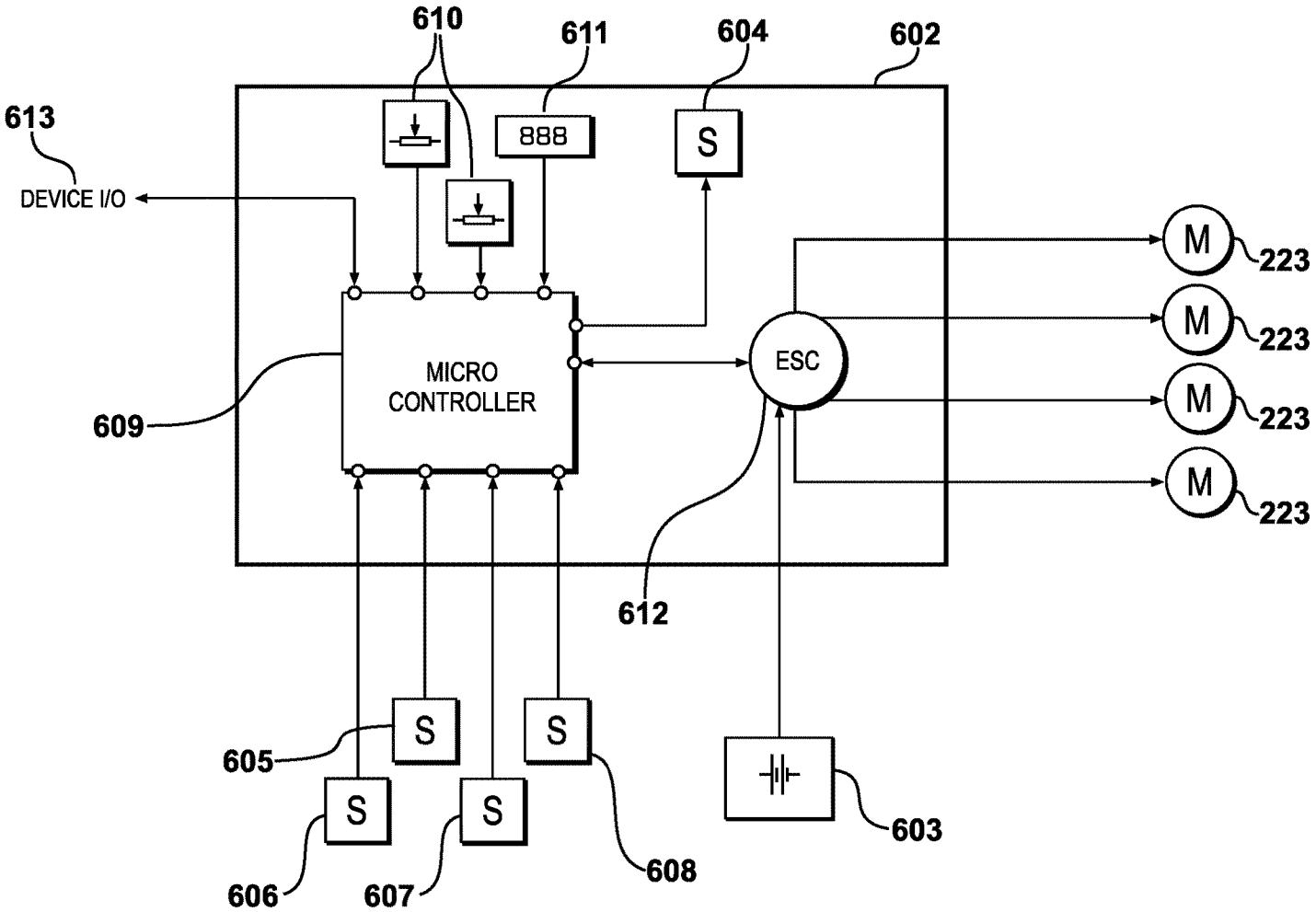
FIG. 6 is a functional block diagram of an electronic control system.

A close up cross-sectional view through the hull 103 of the boat 101 showing the attachment of said stabiliser unit 109 is illustrated in FIG. 6.

As previously described, in the embodiment, the hull 103 of boat 101 is provided with tube housings 401 formed integrally with the hull, positioned either side of the centreline of the hull towards the bow of the boat. The tube housings are open at either end, and define at a first end 501 an open aperture extending through the hull of the boat, along a passage defined internally by the tube housing, to a second open end 502, which second open end is configured to lie above the waterline of the vessel.

In this way, the stabiliser units 109, 110, which are substantially similar to stabiliser unit 107, excepting that they are not fitted with mounting apparatus 216, may be received in the tube housing 401, with the outlier diameter of collars 220, 221 closely matched to the internal diameter of tubes 401. Thus, in this embodiment, the drive apparatus 203 may be separated from the elongate main body 201 in the manner previously described, thus allowing the elongate main body to be inserted upwardly through the tube housing 401, from the lower surface of the hull of the boat upwardly thorough the aperture at the first end 501, until the proximal end 206 of the elongate main body 201 protrudes slightly from the second end 502 of the tube housing 401, and when so located, the drive apparatus 203 may be then be re-attached to the proximal end of the elongate main body by inserting shaft 239 through the housing 225 so as to be inserted through the bore of first and second worm gears 237, 238.

Similarly, the drive apparatus 203 may be detached from the proximal end of the elongate main body 201 as previously described so as to allow the stabiliser units 109, 110 to be withdrawn from the tube housings 401.

FIG. 6

FIG. 6 is a functional block diagram of the control system 111.

In the specific embodiment, said stabilising apparatus 102 is configured as an active stabiliser system, in which the stabilising fin members of the stabiliser units are configured to rotate about their axes of rotation in the manner previously described in FIGS. 4*a* to 4*c*, in response to a control signal received from control system 111 indicative of rolling and/or pitching motion of the boat 101, so as to obviate the rolling/pitching motion and maintain the boat level in the water in which it is immersed.

Thus, in the specific embodiment, a control system is provided in the form of an electronic control system 601. Electronic control system 601 comprises a central control unit 602, a power supply 603, and a plurality of like sensors 604, 605, 606, 607, 608. As illustrated in FIG. 1, in the embodiment the components of central control unit 602 are housed in a plastics housing rigidly attached to the hull 103 of boat 101.

In the embodiment, central control unit 602 comprises a microcontroller device 609 which has a number of inputs and outputs, forming a part of a circuit board having various complementary components to facilitate programming and connection of various other circuits to the microcontroller. In a specific embodiment, board 610 is an Arduino (trade mark) board, although it will of course be appreciated that various alternative boards are readily commercially available. Central control unit 602 includes a plurality of local input devices, such as rotary controls 610, configured to allow manipulation of various functions of microcontroller 609, and a display device, in the form of liquid crystal display screen 611, configured to display information indicating the status of various functions of the microcontroller 609, each of which are mounted to the surface of the protective housing of central control unit 602.

Central control unit 602 is further provided with a local sensor module 604, which, in the specific embodiment, is a three axis accelerometer module. Said sensor module 604 is preferably based on an analog accelerometer integrated circuit, such as, for example, the MMA7361 IC commercially available from Freescale Semiconductor, Inc (trade mark). Accelerometer sensor 604 is able to detect static acceleration (i.e. acceleration under the force of gravity, allowing determination of the static orientation of the sensor), or dynamic acceleration (i.e. that due to movement of the sensor) in all three axis.

Central control unit 602 further includes an electronic speed control device 612 used to control the operation of electric motors 223 of stabiliser units 107 to 110 in response to a signal received from microcontroller 609. Electronic speed controller 612 is configured to control the electrical current supplied to the electric motor 223, to thereby cause the motor to rotate in the desired direction, at the desired speed, thus causing the stabilising fins 202 to rotate to counter a detected pitch/roll of the boat.

Electronic control system 601 further comprises a power supply 603. In the embodiment, power supply 603 comprises an electrochemical cell providing a source of Direct Current (DC) used for powering the operation of the components of electronic control system 601, in addition to the operation of motors 223.

Control system 601 is further provided with a plurality of like sensors 605 to 608. In this embodiment, sensors 605 to 608 are each identical to sensor 604 of central control unit 602, and thus each comprises a three axis accelerometer module configured to detect static and dynamic acceleration about each of its three axis. Sensors 604 to 608 are configured for installation in said stabiliser units 107 to 110 respectively, proximal said fin member 202, such that rotation of said fin member 202 about each of its axis of rotation causes a corresponding rotation of a respective sensor 605 to 608. For example, sensors 605 to 608 may be installed in said stabiliser units 107 to 110, and mechanically attached to said pivot axle 209 of said fin member 202. As an alternative, and if sensors 605 to 608 are adapted to be resistance to water, sensors 605 to 608 may be mounted to the surface of said fin blade 208. Thus, in the embodiment, sensor 605 is installed in said stabiliser unit 107, sensor 606 in said stabiliser unit 108, sensor 607 in said stabiliser unit 109, and sensor 608 in stabiliser unit 110.

In the specific embodiment, the controller is configured as a proportional-integral-derivative controller (PID) controller, which operates as a closed loop control system whose output signal is variable in response to input signals from feedback sensors.

Thus, pitching or rolling of boat 101 causes a corresponding pitching or rolling motion of sensor 104 contained in central control unit 602. Sensor 604 generates a signal indicative of the magnitude and duration of the pitching/rolling motion, in addition to a realtime signal indicative of its orientation.

By receiving a signal from sensor 604 indicative of the magnitude and duration of the pitching/rolling of boat 101, configurable PID control logic in microcontroller 609 can control the operation of electronic speed controller 612, which in turn controls the operation of motors 223 in stabiliser units 107 to 110, causing fin members 202 to rotate about any of their axis in order to correct the pitching/rolling motion. Further, microcontroller 609 receives inputs from sensors 605 to 608 identifying the actual position and motion of fin members 202, thus allowing more accurate control of the rotation of the fin members about their axes.

Moreover, as previously described with reference to FIG. 4*a*, in an embodiment, microcontroller 609 may include functionality to allow manual control of the stabiliser units 107 to 110, for example, to allow the stabiliser units 107 to 110 to be operated to lift the boat out of the water when travelling at speed.

A device I/O (input/output) interface 613 is provided in microcontroller 609 to allow it to communicate with other devices. For example, the microcontroller might be coupled to a wireless control circuit, so as to allow wireless control of the functions of microcontroller, or to facilitate reporting of various parameters by microcontroller 609 to a remote device, such as to a handheld cellular telephone via the GSM network.

It will of course be appreciated that control system 111 may vary in configuration dependent on the exact configuration of said stabiliser units 107 to 110. For example, in an alternative embodiment, said drive apparatus 203 of stabiliser units 107 to 110 may, instead of using an electric motor 223, use, for example, a hydraulic motor, or even a pneumatic motor. In these example, electronic speed controller 612 of controller 601 may instead be substituted with a valve controller, for controlling the flow of working fluid to the hydraulic or pneumatic motors. Further, as already discussed, in the example embodiment illustrated, each said stabiliser unit 107 to 110 is equipped with only a single motor 223 and drive transmission mechanism, for driven the fin member 202 to rotate about only its first axis of rotation. In alternative embodiments, stabiliser units 107 to 110 may be equipped with further like drive apparatus, to allow rotation of the fin members 202 about second and third axes of rotation 215, 222.

What I claim is:

1. A stabilising apparatus for a waterborne vessel comprising a stabiliser unit, said stabiliser unit comprising:

a mounting apparatus in the form of a bracket fixable to a structure of said waterborne vessel;

an elongate main body defining a longitudinal axis suitable for attachment to said waterborne vessel by means of said mounting apparatus;

a stabilising fin member rotatably coupled to said elongate main body about a first axis of rotation and a second axis of rotation;

wherein said first and second axes of rotation are transverse to the longitudinal axis and perpendicular to one-another; and a drive apparatus, attached to said elongate main body and operatively coupled to said stabilising fin member;

wherein the stabilizing fin member, the elongate main body and the drive apparatus are rotatable as a unit relative to said mounting bracket about a third axis of rotation, the third axis of rotation extending parallel to the longitudinal axis of said elongate main body.

2. The stabilising apparatus of claim 1, in which said drive apparatus is configured to exert a torque on said stabilising fin member to cause said stabilising fin member to rotate about said first axis of rotation.

3. The stabilising apparatus of claim 2, in which said elongate main body is configured for attachment to the waterborne vessel adjacent a proximal end of said elongate main body, and in which said stabilising fin member is rotatably coupled to said elongate main body adjacent a distal end of said elongate main body.

4. The stabilising apparatus of claim 1, in which said drive apparatus is releasably attached to said elongate main body by a mechanical coupling to facilitate separation of said drive apparatus from said elongate main body.

5. The stabilising apparatus of claim 1, in which said drive apparatus comprises a motor apparatus and a first drive transmission mechanism operatively coupled to an output shaft of said motor apparatus.

6. The stabilising apparatus of claim 5, in which said motor apparatus comprises an electric motor.

7. The stabilising apparatus of claim 5, in which said elongate main body comprises a second drive transmission mechanism mechanically coupled to said stabilising fin member.

8. The stabilising apparatus of claim 1, in which said mounting bracket comprises first and second connector portions releasably and hingedly connected by a hinge pin, and wherein the hinge pin is configured to be removable to allow separation of said first connector portion from said second connector portion to thereby allow releasable attachment of said stabiliser unit to the waterborne vessel.

9. The stabilising apparatus of claim 1, wherein said stabilising fin member, said elongate main body and said drive apparatus are rotatable as a unit relative to said mounting apparatus about said third axis of rotation facilitating deflection of said unit upon contact with obstacles and said unit being biased towards an orientation in which the stabilising fin member extends outboard of the hull.

* * * * *